US005252037A

United States Patent [19]

Carlson

[11] Patent Number: 5,252,037

[45] Date of Patent: Oct. 12, 1993

[54] PISTON VALVED VERTICAL PUMP FOR PARTICULATE MATERIALS

[75] Inventor: V. R. Carlson, Marion, Iowa

[73] Assignee: Aseptic Technology Engineering Co., Cedar Rapids, Iowa

[21] Appl. No.: 922,674

[22] Filed: Jul. 30, 1992

[51] Int. Cl.[5] ..... F04B 7/04; F04B 17/00; B67D 5/40

[52] U.S. Cl. ..... 417/339; 222/383; 417/344; 417/346; 417/507; 452/42

[58] Field of Search ..... 417/507, 344, 345, 346, 417/339; 222/383, 148, 309; 452/42

[56] References Cited

U.S. PATENT DOCUMENTS

| | | | |
|---|---|---|---|
| 3,125,257 | 3/1964 | Vukich | 222/309 |
| 3,589,567 | 6/1971 | Massenbach | 222/383 |
| 3,994,627 | 11/1976 | Calzolari | 417/344 |
| 4,527,954 | 7/1985 | Murali et al. | 417/346 |
| 4,723,581 | 2/1988 | Standenrausch | 452/42 |
| 5,029,735 | 7/1991 | Dennis | 222/148 |

FOREIGN PATENT DOCUMENTS

| | | | |
|---|---|---|---|
| 34126 | 2/1985 | Japan | 452/42 |
| 802031 | 9/1958 | United Kingdom | 222/383 |

*Primary Examiner*—Richard A. Bertsch
*Assistant Examiner*—Roland McAndrews
*Attorney, Agent, or Firm*—Allegretti & Witcoff, Ltd.

[57] ABSTRACT

A piston pump for conveying fragile particulate food products without damaging the product. The pump includes a filler and a discharge conduit containing piston valves actuated by hydraulic cylinders. The pumping chamber in which the product is compressed is equipped with a linear displacement transducer/magnet sensor which senses not only the position, but the speed of the piston. In response to the sensor, a proportioning valve releases hydraulic fluid at increasing pressure to a desired maximum, to the hydraulic cylinder actuating the piston in the pumping chamber of a second pump operating in tandem with the first pump. The product is expelled alternatively from the two pumps at the maximum desired pressure appropriate for the character of the product. The pump also includes means for flushing the pump without dismantling.

13 Claims, 3 Drawing Sheets 62
14
54
56
34
52
80
32
66
46
50
63
10
76
82
75
64
78
73
31
74
47
70
35
48
38
72
36
40
30
68
26
28
42
44
84
24
22
16
41
18
18
20

145
94
92
91
90
108
109
107
106
96
97
98
99
100
101
102
103
104
105
110
112
114
116
118
120
122
124
126
128
130
132
134
136
138
140
142
46
52
64
68
74
76
80
84
35
36
38
41
42
95
46'
68'
74'
76'
36'
38'
41'
42'
102'
105'
138'
140'
142'

PISTON VALVED VERTICAL PUMP FOR PARTICULATE MATERIALS

BACKGROUND OF THE INVENTION

This invention relates to a pump for pumping food products, particularly products which contain particulate materials which are easily crushed, broken in pieces, or are "rounded", so they are not discrete. The pump is self-cleaning without dismantling.

PRIOR ART

Food processing pumps disclosed previously were designed to handle non-edible materials having large pieces of solid material. They required disassembling for cleaning and were not capable of moving gently at constant volume fragile products like raspberry in syrup. The prior art piston pumps were mounted horizontally so that the product being pumped from an overhead tank had to be diverted from vertical to horizontal flow, which frequently caused fragile products to be broken up.

The prior pumps had no provision for controlling the velocity of the piston in the pumping chamber. Consequently, the speed, acceleration and deceleration of the piston was responsive solely to the pressure generated by the hydraulic power unit. The movement of the pumping piston and the piston valves comprising the pump was jerky and irregular, resulting in non-uniform flow and undesirable pulsations. This is particularly severe when changing from one pump to another where two or more pumps are operating in tandem. There was no provision for adjusting the speed of the piston to accommodate the viscosity of the product. For example, products containing air should be compressed in the cylinder of the pump more slowly than dense or highly viscous products. Applying full-line pressure to the piston instantaneously damages fragile particles in the product.

OBJECTS OF THE INVENTION

The object of this invention is to provide an hydraulically operated piston pump, preferably an assembly of two or more pumps, which can move fragile food products in the form of slurries at high rates and high pressures (to 800 psi) under sanitary conditions without damaging the product. Another object is to provide such a pump having minimum piston seal wear. A further object is to provide a pump which has high pressure capability and which is operative over a range of pressures; which moves product at a constant rate without pulsating; which can be cleaned to meet food sanitation standards without dismantling; and which includes means for controlling the opening and closing of the suction and discharge valves in response to position and speed of the pumping piston to eliminate undesirable pulsations.

A still further object is to discharge product from the pump at approximately the same pressure prevailing in the processing system receiving the product downstream of the pump and to increase the pressure in the pump cylinder gradually to that prevailing pressure.

SUMMARY OF THE INVENTION

The pump of the invention has a vertically disposed cylindrical pumping chamber which is supplied with food product from a vacuum tank, or hopper, mounted just above the pump chamber. This arrangement provides for direct flow of product by gravity and is superior to prior pumps which are horizontally disposed, requiring the product to change direction by 90° as it flows from the product supply tank. This vertical pump arrangement has an efficiency of 95–98% as compared with approximately 85% for a horizontally-disposed pump. The efficiency is a function of the volume that theoretically can be delivered compared to the actual amount delivered. (Efficiency is also a function of discharge pressure and viscosity of product.) If the product contains gas, e.g. chopped tomatoes, it is compressed and a lesser volume is pumped than where the product is not compressible, e.g., peas in brine.

The vertically moving piston in the pump, with the help of gravity, draws the product into the pumping chamber and is effective in moving the product from the vacuum supply vessel even when the product is under vacuum and is highly viscous, e.g., chopped tomatoes having 80–90% particles, pineapple tidbits, hash, and similar products which have a reduced tendency to flow. The more viscous the product, the more difficult it is to fill the pumping chamber with product. The vertical arrangement facilitates product flow.

To provide a smooth continuous flow of particulate product to ancillary equipment for additional processing, the invention provides for two or more of these piston pumps operating in tandem. The first pump expels product through a discharge conduit while a second pump is sucking in product from the supply tank. Thus, the feed from the pumps is continuous and uniform. The pressure in the pump chamber after filling with product can be gradually increased during the displacement step by controlling, through valves, the pressure to an hydraulic cylinder which actuates the piston in the pump chamber. The time for expelling product from the chamber also can be controlled.

The position, velocity and acceleration of the pump piston is sensed by use of a commercially available linear displacement transducer. This sensor, which operates magnetically, need not contact the piston or other moving parts being monitored. Magnetic signals (+10 to −10 volts) from the sensor are converted to electric signals (4–20 milliamps) and fed continuously to a process logic controller or microprocessor which transmits proportional electrical signals to solenoid valves which control the flow of hydraulic fluid to the cylinders which move the pistons in the pump chambers. Accurate sensing provides essentially pulse-less flow from the pumps operating in tandem. This is not possible using position-sensing switches or micro switches of the prior art.

Pumps of this kind may be very large having piston rods 20–24 inches long or longer. The diameter of the pistons will range from 3 inches to 12 inches. If mounted horizontally, the ring seals on the piston wear excessively on the underside and must be replaced frequently. Vertical mounting obviates this problem.

At very high flow rates, it may be desirable to use more than two cooperating pumps. Increasing the capacity of a pump requires increasing the operating pressure which in turn dictates use of heavy pump cylinders, thicker piston valves and bigger hydraulic cylinders to drive the pump and actuate the valves. These large parts cannot be manually handled because they are so heavy. Mechanical handling equipment required to assemble and disassemble the pumps is expensive and requires considerable space for operation. Thus, it is economically feasible to add smaller pumps to the pump assembly rather than increase the size of a fewer number of pumps. A third and fourth pump can easily be programmed in the controlling computer.

The pump of the invention also includes means for cleaning in place. Sanitation is of primary importance in a food processing plant. After use, and when the product being processed is changed, the pumps must be carefully cleaned. As described herein, water and cleaning solutions can be circulated through the pump to flush out all particulate matter in the valves, valve seals, valve seats, and the pump chamber without disassembling, scrubbing and reassembling. Downtime of the pumps, as well as labor, is saved by this feature of the invention. Also, damage during disassembly and assembly is avoided.

THE DRAWINGS

These and other objects and advantages of the invention will become apparent from the following description when read in connection with the accompanying drawings in which FIG. 1 is an elevational side view partially in section of a pump constructed in accordance with the invention in combination with a product supply tank.

DETAILED DESCRIPTION

Figure 2:
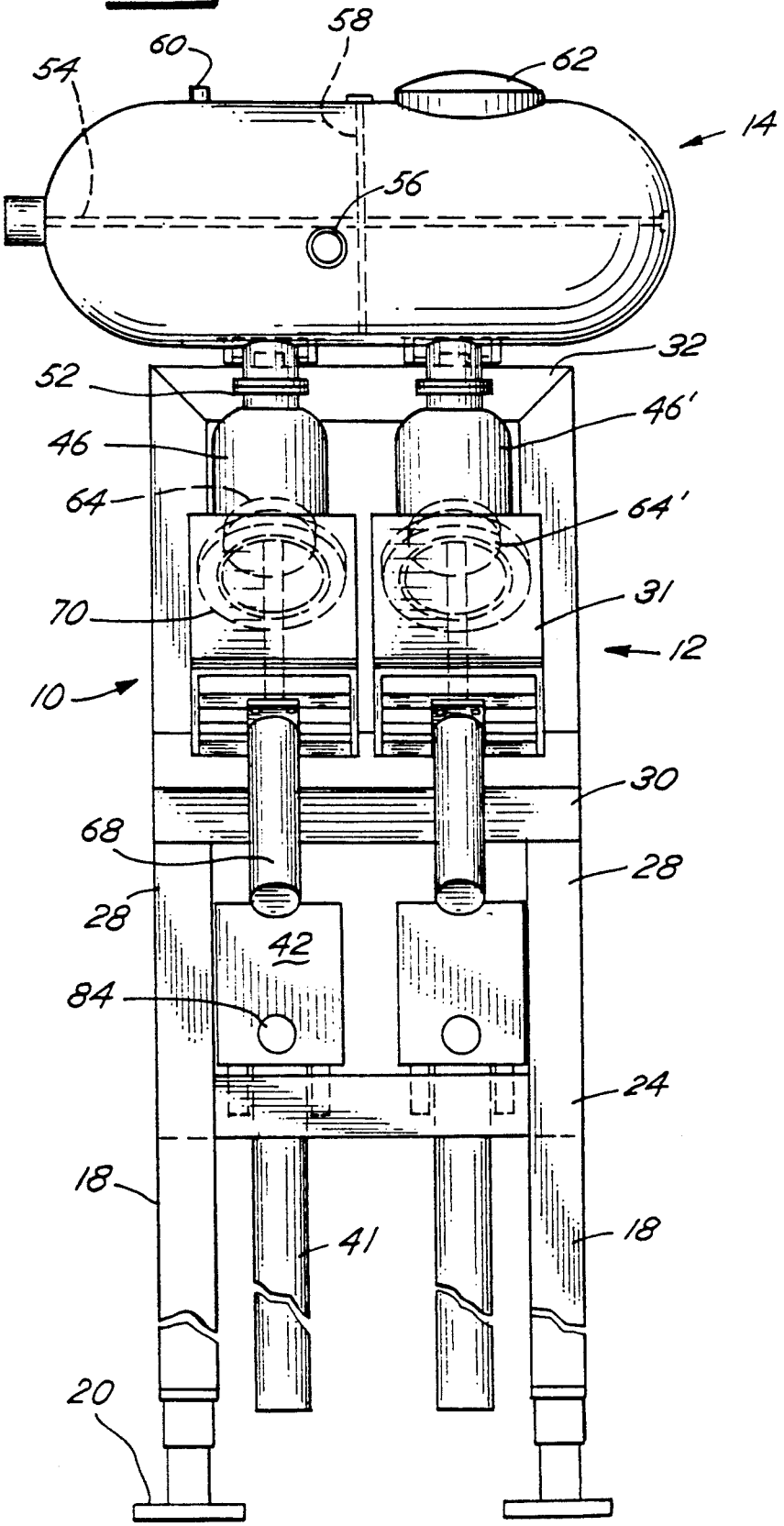
FIG. 2 is a front elevational view of a pair of pumps of the type shown in FIG. 1 and the product supply tank.

Piston pumps 10, 12 are vertically mounted side by side and connect to a product supply tank 14 just above the pumps. Tank 14 has an agitator 54, an inlet fitting 56, a level sensor 58, an access opening 62, and a vacuum connection 60. The tank 14 may be evacuated to remove air from the product. The pumps 10, 12 are supported by a tubular metal base having four legs 18 connected at the top by cross member 22 and terminating at the bottom in feet 20 which rest on the floor. As best shown in FIG. 2, these frame structures at each side are connected by tubular members 24 which support uprights 26, 28 welded to cross members 22. If desired, the upright members can be replaced by a sheet of stainless steel to which the valves and other elements are attached. The main body of the pump consists of a cylindrical pumping chamber 36 in which piston 38 mounted on rod 40 moves up and down to suck in and expel products introduced into the pump from tank 14. The lower end of the cylindrical chamber 36 widens out into a flushing fluid chamber 42 which is described in more detail below. An outlet tube 44 connects to the chamber 42 in the sidewall near the bottom. The piston rod 40 connects to a hydraulic cylinder 41 which actuates the pump.

Attached to a flange 48 at the top of the cylinder 36 is a valve housing 46 having four openings. Opening 47 is aligned with the cylinder 36. Opening 63 branches off at an acute angle from the axis of cylinder 36 and houses the suction valve 64. Opening 52 at the top has a flange which mates with a corresponding flange on an outlet pipe in the bottom of tank 14. Opposite the opening 63 is an opening 73 which connects to a Y. One leg of the Y is the discharge conduit 74 and the other leg of the Y houses the piston valve 76 which closes off the discharge conduit 74 be sealing against valve seat 78. The suction piston valve 64 and the discharge piston valve 76 are mounted in bearings 70, 82, respectively. The bearings are sealed with O-rings 75 in the conventional manner. Valves 64 and 76 are actuated by means of hydraulic cylinders 68 and 80, respectively. Cylinder 80 is welded, or bolted, to an extension 34 from the member 32 constituting part of the frame at the top of upright 26. Member 32 is also welded to valve body 46 as indicated at 50. An angle iron 30 is secured to the top of the upright 28 and is welded, or bolted, to a ring 35 at the top of the cylinder 68. An arm 31 connects to the valve housing 46 to provide a rigid connection between the pump proper, the valve and the cylinder 68.

The piston 64 moves into the opening 63 against valve seat 66 to close off the connection between tank 14 and the pump when product is being expelled from the pump 10. The head of the piston valve 76 seats on a circumferential seat 78 in the opening 73 to close off the connection between the pump and the discharge conduit 74. This valve is closed when product is being transferred from the tank to the pump through the valve housing 46.

A mechanical stop 84 is provided near the bottom of the flushing fluid chamber 42 to arrest downward movement of the piston head 38, except when the pump is being cleaned, at which time the stop is inoperative. The stop is hydraulically actuated.

OPERATION OF PUMPS

Figure 3:
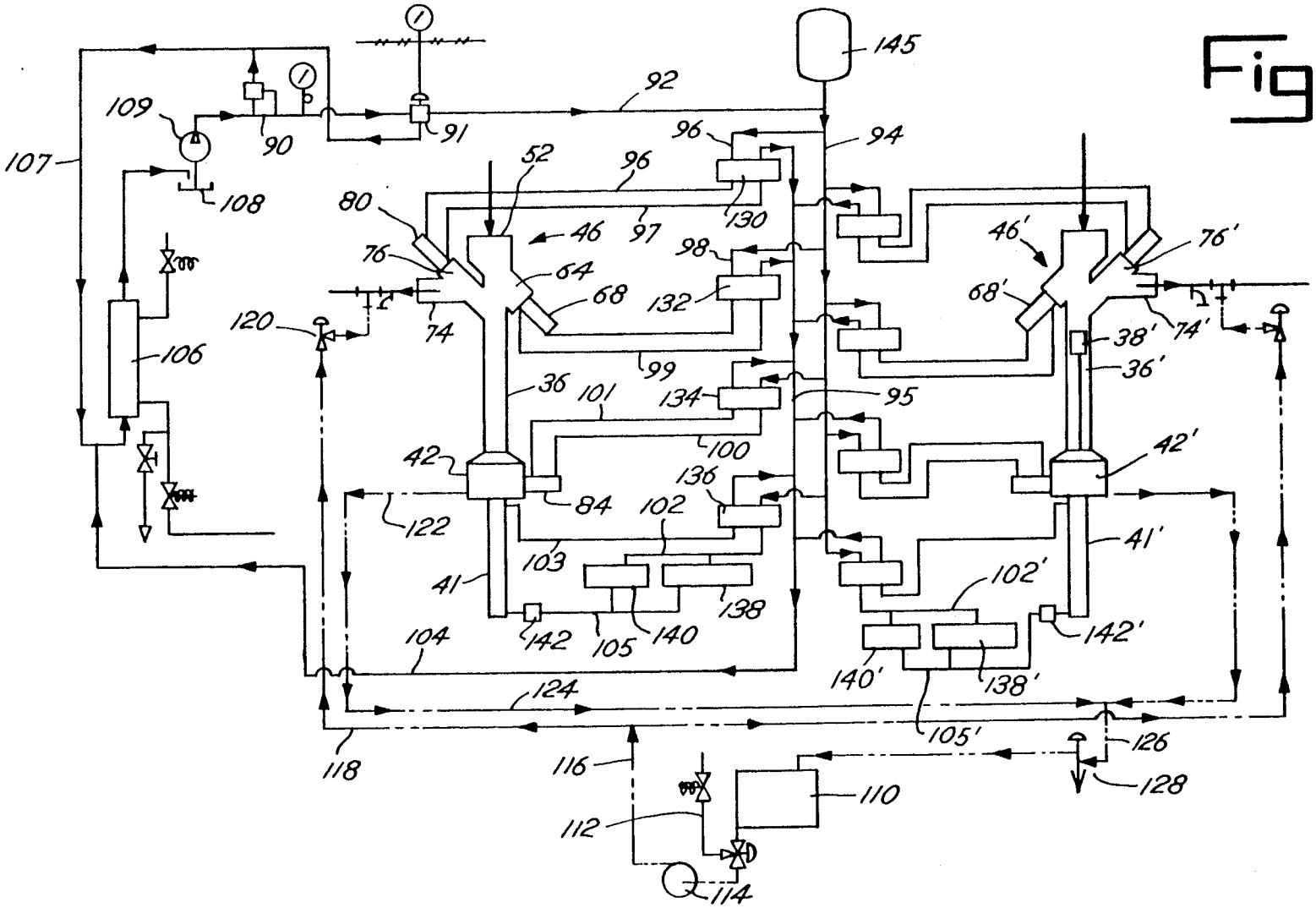
FIG. 3 is a diagrammatic representation of control means for operating a pair of pumps as shown in FIG. 2.

The operation of each of the pumps and the manner in which they cooperate with each other is illustrated by the diagram of FIG. 3. The piston valves 64 and 76 are actuated by means of hydraulic cylinders 68 and 80, respectively. Similarly, the piston 38 in the pump chamber 36 is actuated by the hydraulic cylinder 41. The flow of hydraulic fluid to and from the cylinders of one pump is controlled by servo and solenoid valves responsive to electrical signals from a linear displacement transducer or similar sensor on each of the hydraulic cylinders in the other pump. These sensors monitor continuously the location, speed, acceleration and deceleration of the pistons in the hydraulic cylinders. The computer is programmed to control the sequence of operations of the valves and the primary pistons in the pumping chambers of the pump assembly in response to signals generated by the sensors.

Basically, the sequence of operations in each pump is as follows: While the suction valve 64 is open and the discharge valve 76 is closed, the primary piston 38 in the pump chamber 36 moves downwardly to draw into the pump product from the tank 14. The suction valve 64 then closes to shut off the connection between the tank and the pump. The piston 38 in the pump then reverses direction and gradually builds up pressure at a rate tolerable to the product. When the pressure reaches the downstream pressure, valve 76 opens and product is expelled through outlet conduit 74.

Referring to FIG. 3, hydraulic fluid is supplied at a predetermined pressure from pump 109 through lines 90, 92, 94 and branch lines to the various hydraulic cylinders controlling the operation of pump 10. The hydraulic fluid leaving the operating cylinders flows through the return line 104 to a heat exchanger 106 to cool the fluid. The cooled fluid then flows into the reservoir 108 where it is fed to the pump 109. A valve 91 is set to control the pressure applied to the hydraulic fluid. The maximum pressure is set manually or by the computer program. Valve 91 is operated by an air, or electric, valve responsive to the controls. The hydraulic fluid generator is designed to produce fluid at up to 1,500 pounds per square inch pressure. The pressure may exceed 1,500 psi. Hydraulic fluid at the desired pressure flows from main line 94 to line 96 and valve 130 to actuate the cylinder 80 which in turn controls the opening and closing of discharge valve 76. Fluid leaving the opposite end of cylinder 80 flows through return line 97 which connects to line 104 through line 95. Solenoid valve 130 controls the flow of hydraulic fluid to and from opposite ends of the cylinder 80 to open and close the valve 76 in accordance with the program. Similarly, branch line 98 and solenoid valve 132 control the flow of hydraulic fluid to and from the ends of hydraulic cylinder 68 which in turn closes and opens suction valve 64. In the same manner, fluid is supplied through solenoid valve 134 to actuate the stop 84. The cylinders and valves in pump 12 performs in the same way as those in pump 10.

A special arrangement is provided for supplying pressure to the actuating cylinder 41. Fluid pressure is admitted first through solenoid valve 136 to proportioning servo valve 138, or other type of pressure proportioning valve. Valve 138 opens at a predetermined pressure from between 0 and 1,500 psi and admits fluid to cylinder 41 at gradually increasing pressure. When the maximum pressure is reached, valve 140 opens and hydraulic fluid is admitted to the cylinder 41 through line 105 and flow meter 142. The hydraulic fluid from the tops of the actuating cylinders is recirculated through line 104 to the cooling heat exchanger 106, as explained above.

The valve 138 builds up pressure in cylinder 41 and consequently in chamber 36 at the maximum rate the product in the chamber will tolerate. Products containing large quantities of air are compressed over a longer time than denser, solid products. When the pressure on the product reaches the pressure in the system downstream of the discharge conduit 74, valve 76 opens to permit product to be discharged through conduit 74. When valve 76 opens, solenoid valve 140 opens to allow full hydraulic pressure in line 94 to bear on cylinder 41 to expel the product. The accumulator 145 holds a reserve supply of hydraulic fluid when pump 109 cannot deliver adequate fluid to operate simultaneously cylinders 41 on pump 10 and cylinders 68' and 80' (to open valves 76' and 64') on pump 12.

Coordinating in this way the movement of the pistons in cylinders 36, 36' and the opening and closing of the suction and discharge valves on both pumps, vibrations and pulsations in the system are practically eliminated. Reducing pulsations is also attributable to operating at low hydraulic pressure. Pump 109 is capable of operating up to 3,000 psi. Since the speed of the pumps 10, 12 is controlled by the pressure in the system, the reduction in vibrations and pulsations is achieved at the expense of the rate at which product is expelled from the pumps. To increase operating speed, where the product will stand it, the pressure at pump 109 may be increased to 1,800–2,000 psi. Operating speed can also be increased by using larger cylinders, which can be operated at higher pressures without producing the vibrations and pulsations associated with smaller cylinders operating at higher speeds.

The rate at which the pumps are producing cannot be measured accurately because of the variation in the density of the product. On the other hand, the hydraulic fluid is not variable. By using scaling factors, the rate of flow of the hydraulic fluid can be correlated with product flow. By entering the scaling factor into the computer, the output of the pumps can be controlled by controlling the pressure in the hydraulic cylinders and output of valve 140, which controls fluid flow to cylinders 41, 41'.

CONTROLS

Figure 1:
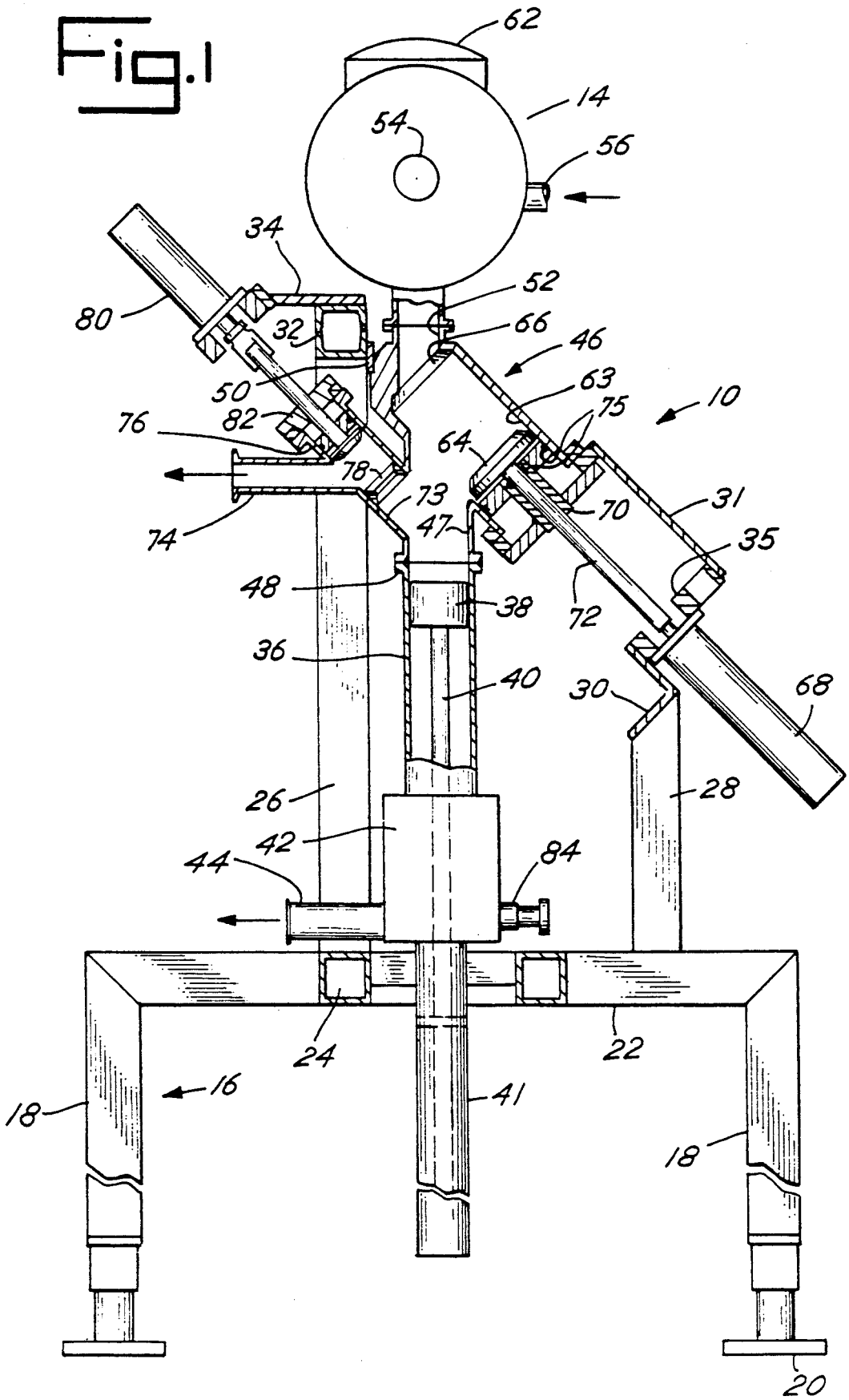

The controls used to sense the position of the pump piston 38 in the pumping chamber 36 and the position of the valve pistons in the suction and discharge conduit 64, 44 are not shown in the drawing. The position, speed and rate of acceleration or deceleration of piston 38 in pumping chamber 36 of both pumps 10 and 12 is sensed by a linear displacement transducer **41*a* on the cylinder 41 having a stationary probe 41*b* and a cooperating magnetic ring on the piston bottom of rod of cylinder 41 as shown in FIG. 1. The piston 41*d* speed for products that do not flow well is slower than that for readily-flowable products. Both pumps 10 and 12 discharge product into a common line downstream of discharge conduits 74, 74' for further processing. To insure discharge of product into the common line at a constant rate, flow of product occurs simultaneously from both pumps as the pump piston 38 decelerates near the end of its stroke. To compensate for reduced flow, the piston in the second pump accelerates to produce a constant volume of product into the line downstream of the pumps. A microprocessor computer chip programmed for the proper sequence of operations and the desired speeds and pressures transmits signals to the solenoid valves which control the actuating cylinders of each of the pumps 10, 12. The sequence of operations for pump 10 follows: Hydraulic fluid from pump 109 is set at the desired pressure which controls the speed of the pump. Suction valve 64 is closed and discharge valve 76 is open. Piston 38 in the chamber 36 is positioned at the top of the cylinder as shown in FIG. 1. The cooling water to the heat exchanger 106 is turned on. Valve 134 opens to admit fluid from the pressure line 94 to the cylinder controlling the stop 84. The stop is placed in operative position to arrest the piston 38 from descending below the stop into the chamber 42. Discharge valve 76 is closed. Suction valve 64 opens as hydraulic fluid is admitted through solenoid valve 132 to cylinder 68. This provides a clear passage between the supply tank 14 and the interior of the pump through valve body 46. As the desired hydraulic pressure is admitted through the valve 136 to the hydraulic cylinder 41, the primary piston 38 is drawn downwardly to suck product from the tank into the chamber 36. At the end of the stroke, the piston remains at rest for 0.1 to 1.0 second. During this time, the suction valve 64 closes as the fluid flow to cylinder 68 is reversed by valve 132. At this point, piston 38' in pump 12 is decelerating near the end of its pumping stroke. The linear displacement transducer on cylinder 41' senses the deceleration and sends a signal to the microprocessor which actuates piston 38 in pump 10 by means of valves 138 and 140 which admit hydraulic fluid to cylinder 41. The pressure in pumping chamber 36 gradually builds up as the proportioning valve 138 increases pressure in cylinder 41. The pressure increases at a rate tolerable to the fragile product. The time may be from a fraction of a second to 4 to 5 seconds. The desired maximum pressure is equal to the pressure in the line downstream of discharge valve 76. Before piston 38' in pump 12 reaches the end of its pumping stroke, its position is sensed by the transducer-sensor which signals the computer, which in turn signals valve 130 to open discharge conduit 76. Simultaneously, valve 140 opens to apply fill line pressure to cylinder 41. The piston 38 moves at a rate inversely proportioned to the rate of deceleration of piston 38' to insure a constant rate of product flow through conduit 76 into the line downstream of the pumps as the flow from pump 12 diminishes. At the time valve 140 opens, flow meter 142** sends a signal to a rate indicator which indicates product flow rate.

While product is discharged from pump 10, the pumping chamber of pump 12 is refilled in the same manner as pump 10 as described above. As piston 38 nears the end of its pumping stroke, valve 76 begins to close and valve 76' begins to open. Pressure, built up within 0 to 5 seconds in chamber 36', forces product out of discharge conduit 74' in an amount to compensate for the diminished flow from conduit 74. At this point, the cycle repeats.

By accurately sensing the speed and position of the pumping pistons during the changeover from one pump to another, and controlling the timing of the discharge and suction valves and the pressure in the pumping chamber, a constant uniform flow of product is assured.

CLEANING THE PUMP

The cleansing operation of the pump will be described only in connection with left-hand pump 10 shown in the drawing. The same procedure is used for pump 12. The mechanical stop 84 is retracted to permit piston 38 to retract into the bottom of cleaning fluid chamber 42. Air actuated valve 120 is closed, suction valve 64 is closed, and discharge valve 76 is closed. At this point, cleaning fluid from tank 110 or water from line 112 is pumped by the pump 114 to line 116 which leads to the valve housing through line 118. Valve 120 is then opened intermittently to admit flushing fluid to chamber 36 of pump 10 for approximately 2½ minutes. Flow to each pump is pulsed by closing the valve 76 for 5 to 10 seconds and then opening the valve. Full flow is interrupted for 5 to 10 seconds during four cycles. The pump 12 is cleaned in the same way. Alternate water and cleaning solution from tank 110 are utilized to provide effective cleaning. Water or cleaning solution is expelled from the pump through outlet 44. Water is discharged through lines 122, 124, 126 to drain 128. Similarly, wash solution is discharged through lines 122, 124 and back to the container 110 or out drain 128, depending on its condition.

When the pumps are shut down after cleaning, suction valve 64 and the discharge valves 76 are opened, the piston 38 is at the top of the stroke and all water valves are closed. Motors to the pumps 109 and 114 are also shut off.

What is claimed is:

1. A high capacity piston pump for conveying slurries without damaging particulate material therein comprising:

a vertically-disposed cylindrical pumping chamber, a cleaning fluid chamber communicating with said pumping chamber at the lower end thereof, a discharge conduit connecting to the upper end of said pumping chamber at one side thereof, a piston valve disposed in said discharge conduit, a filler conduit connecting to and aligned with said pumping chamber above said discharge conduit, a suction valve comprising a cylinder connecting to said pumping chamber at an acute angle to the axis of said pumping chamber between said discharge conduit and said filler conduit, a piston disposed in said suction valve which moves into and out of said filler conduit to close and open the conduit, a piston within said pumping chamber and actuated by an hydraulic cylinder for movement between said discharge conduit and said cleaning fluid chamber, and a supply tank connecting to said filler conduit.

2. The pump of claim 1 which includes an annular valve seat within said filler conduit which mates with said suction valve piston.

3. The pump of claim 1 which includes a moveable stop adjacent said pumping chamber to prevent said hydraulically-actuated piston from moving into said cleaning fluid chamber.

4. The pump of claim 1 in which said filler conduit, said valve in the discharge conduit and said suction valve comprise parts of a fitting secured to the top of said pumping chamber.

5. The pump of claim 1 in which said supply tank includes means for reducing the pressure inside the tank.

6. The pump of claim 1, in which said cleaning fluid chamber has an outlet near the bottom thereof, in combination with a source of cleaning fluid communicating with said discharge conduit, and pump means for circulating said cleaning fluid into said discharge conduit and out said outlet to flush said pumping chamber.

7. The pump of claim 1 which includes an hydraulic cylinder for actuating said discharge conduit valve, an hydraulic cylinder for actuating said suction valve, control valves for controlling the flow of hydraulic fluid to and from said hydraulic cylinders and means for actuating said control valves in a predetermined sequence responsive to the position of said piston within said pumping chamber.

8. A pump assembly comprising a first and a second pump constructed in accordance with claim 5 mounted side by side and means for coordinating the action of the respective hydraulic cylinders in both pumps whereby 1) the pumping chamber of said first pump is filled with product from said tank while the suction valve is open and said discharge conduit valve is closed, 2) simultaneously with the filling of said first pump, product existing in the pumping chamber of said second pump is expelled while said discharge conduit is open and said suction valve is closed, to produce a smooth continuous flow of product through said pump assembly.

9. The pump assembly of claim 8 in which the hydraulic cylinders actuating the pistons within their respective pumping chambers connect to a common source of pressurized hydraulic fluid, and which includes valve means interposed between said common source and the hydraulic cylinders actuating the pumping chamber pistons, said valve means being adjustable to control the fluid pressure on said hydraulic cylinders.

10. The pump assembly of claim 9 in which said adjustable valve means causes the hydraulic fluid pressure on said hydraulic cylinders, which actuate the pumping chamber pistons, to increase gradually as the pumping chamber piston rises in said pumping chamber.

11. The pump assembly of claim 8 which includes a common source of pressurized hydraulic fluid to supply fluid to each of the hydraulic cylinders for actuating said piston valves and said hydraulic cylinders which actuate the pumping chamber pistons in said first and second pumps, a common source of pressurized cleaning fluid to supply said cleaning fluid to the discharge conduits of said first and second pumps, and an outlet in said cleaning fluid chambers of said first and second pumps.

12. The pump assembly of claim 11 which includes a line connecting said source of pressurized cleaning fluid with said discharge conduits, of said first and second pumps, and a valve in said line to permit pulsing the flow of cleaning fluid to said pump by closing and opening said valve.

13. An assembly of two piston pumps operating in tandem to supply particulate food product in precise metered quantities to processing equipment operating at a maximum pressure downstream of the pumps, each pump having a pumping chamber, a piston in said pumping chamber, a filler conduit and a discharge conduit, a piston valve in each said filler and said discharge conduits, hydraulic cylinders for actuating said pumping chamber piston and said piston valves, means on said pumping chamber for sensing continuously the position and speed of said pumping chamber piston, said sensing means comprising a linear displacement transducer and cooperating magnet, solenoid valve means responsive to said sensing means for actuating said hydraulic cylinders in a predetermined time sequence and proportioning valve means for supplying hydraulic fluid to the hydraulic cylinder actuating said pumping chamber piston at an accelerating rate to increase the pressure on said product up to said maximum pressure whereby product being expelled from one pump at below a predetermined pressure at the end of the stroke of the pumping chamber piston, is complemented by product expelled from the other pump at the beginning of the stroke of the pumping chamber piston to discharge product at a constant rate and pressure.

* * * * *